US009316222B2

(12) United States Patent
Strahov et al.

(10) Patent No.: US 9,316,222 B2
(45) Date of Patent: Apr. 19, 2016

(54) DOUBLE-ACTION SUCKER-ROD WELL PUMP

(75) Inventors: Dmitriy Vitalevich Strahov, Bugulma (RU); Vladimir Borisovich Osnos, Bugulma (RU); Igor Mikhailovich Bessonov, Richmond Hill (CA)

(73) Assignee: Vladimir Vasilevich Kuneevskly, Bugulma (RU)

( * ) Notice: Subject to any disclaimer, the term of this patent is extended or adjusted under 35 U.S.C. 154(b) by 410 days.

(21) Appl. No.: 13/876,042

(22) PCT Filed: Sep. 14, 2011

(86) PCT No.: PCT/RU2011/000709

§ 371 (c)(1),
(2), (4) Date: Mar. 26, 2013

(87) PCT Pub. No.: WO2012/044203

PCT Pub. Date: Apr. 5, 2012

(65) Prior Publication Data

US 2013/0195702 A1 Aug. 1, 2013

(30) Foreign Application Priority Data

Sep. 27, 2010 (RU) ..... 2010139395

(51) Int. Cl.
*F04B 49/22* (2006.01)
*F04B 47/00* (2006.01)
*E21B 43/12* (2006.01)

(52) U.S. Cl.
CPC ..... *F04B 49/22* (2013.01); *E21B 43/127* (2013.01); *F04B 47/00* (2013.01)

(58) Field of Classification Search
CPC ..... F04B 47/00; F04B 47/026; F04B 49/22; F04B 53/1002; F04B 53/1005; E21B 43/12; E21B 43/127; E21B 43/126
USPC ..... 417/534, 547, 555.2
See application file for complete search history.

(56) References Cited

U.S. PATENT DOCUMENTS 2,289,401 A * 7/1942 Yost ..... F04B 47/00 138/148
3,594,103 A * 7/1971 Hillis ..... F04B 53/162 166/105.5

(Continued)

FOREIGN PATENT DOCUMENTS

RU 2386018 C1 * 4/2010

*Primary Examiner* — Nathan J Newhouse
*Assistant Examiner* — Connor Tremarche
(74) *Attorney, Agent, or Firm* — Abelman, Frayne & Schwab

(57) ABSTRACT

A pump includes a two-stepped cylinder with cavities and a lower intake valve, and is connected to a tubing-string via a sub, which includes an upper intake valve and discharge valve. A hollow plunger is arranged in the cylinder below and above the cavities. The plunger is connected to a hollow rod and has a lower discharge valve and a through-hole provided above the lower discharge valve to provide communication between the plunger cavity and a chamber formed as said plunger is moved downwards in a lower step of the cylinder. An upper step of the cylinder includes an inner diameter which is smaller than the inner diameter of the tubing-string. The upper discharge valve is a bush arranged on the rod with longitudinal movement upwards along said rod with excess pressure in the cylinder cavity above the plunger, and downward movement in the liquid under its own weight.

2 Claims, 1 Drawing Sheet

(56) References Cited

U.S. PATENT DOCUMENTS 3,861,471 A * 1/1975 Douglas ..... 166/369
5,104,301 A * 4/1992 Brewer ..... 417/559
6,273,690 B1 * 8/2001 Fischer et al. ..... 417/555.2
8,708,040 B2 * 4/2014 Wilson ..... E21B 43/127 166/109
2013/0302193 A1 * 11/2013 Gabdullin ..... E21B 43/127 417/440

* cited by examiner

DOUBLE-ACTION SUCKER-ROD WELL PUMP

FIELD OF THE INVENTION

This invention relates to oil producing industry, in particular to double-action sucker-rod well pumps.

PRIOR ART

A double-action sucker-rod pump is known that comprises a plunger with a piston rod and an internal passage, and a barrel with a traveling valve, a standing valve and an auxiliary standing valve. A rod string is made hollow, and the barrel is provided with a passage, an auxiliary traveling valve and a sealing assembly for the plunger piston rod, which assembly is arranged on the barrel top. The under-plunger cavity of the barrel is made with the possibility of communicating with the rod string cavity via the traveling valve and the plunger inner cavity. The barrel above-plunger cavity is made with the possibility of continuously communicating with the above-packer well space via an auxiliary standing valve and with the rod string cavity via an auxiliary standing valve and a passage. Further, the rod string may be connected to the plunger piston rod of the sucker-rod pump by an automatic coupler (RU 49106 U1).

Shortcomings of this known pump are complexity and low reliability of round-trips due to the necessity of simultaneously lowering a pipe string with a pump and a plunger provided with a piston rod, with subsequent lowering of rods provided with an automatic coupler for the purpose of connecting same to the plunger. This all requires precise joining of rods and the piston rod, which is performed in several attempts. Moreover, an automatic coupler may be clogged or damaged when being joined with the piston rod, which requires an additional round trip for cleaning or replacing the automatic coupler. Furthermore, this known pump is characterized by a low efficiency due to high resistance in the upper traveling valve, since the latter has a very small flow section because it is arranged between the barrel and the wellbore wall. Also, it is impossible to set this pump capacity by adjusting a volume ratio of its under-plunger cavity and the above-plunger cavity during a downward motion and an upward motion.

The closest analogous solution is a double-action sucker-rod well pump comprising a barrel having a lower standing valve and connected to a pipe string with the use of a sub provided with an upper standing valve and an upper traveling valve, and a hollow plunger arranged in the barrel so as to form an under-plunger and an above-plunger cavities, being able to move reciprocally, coupled with a hollow rod and having a lower traveling valve (RU 2386018 C1).

Shortcomings of this pump are complexity and high cost of round-trips due to the necessity of simultaneously lowering a pipe string with a pump and rods with a plunger arranged in the barrel, which requires use of lowering cranes having a stroke at least twice as great as a length of pipes in a string to be lowered. Furthermore, this pump is characterized by low efficiency due to high resistance in the upper traveling valve, since the latter has a very small flow section because a distribution coupling is to be arranged above it, between hollow rods arranged along the barrel axis, and the pipe string wall. Also, this pump cannot be used when liquids are mixed and for setting the pump capacity by adjusting a volume ratio of its under-plunger cavity and the above-plunger cavity during a downward motion and an upward motion.

SUMMARY OF THE INVENTION

The objective of this invention is to provide a reliable and easy-to-operate pump having high efficiency and enhanced performance capabilities.

The technical effect achieved by the invention is reduced hydraulic resistance of the upper traveling valve, the possibilities of lifting a liquid from the above-plunger and under-plunger cavities of the barrel, and setting the pump capacity by adjusting a volume ratio of its under-plunger cavity and the above-plunger cavity during a downward motion and an upward motion.

The said objective is fulfilled, and the technical effect is achieved owing to the fact that, according to the invention, the double-action sucker-rod well pump is provided, comprising a barrel having a lower standing valve and connected to a pipe string with the use of a sub provided with an upper standing valve and an upper traveling valve, and a hollow plunger arranged in the barrel so as to form an under-plunger and an above-plunger cavities, being able to move reciprocally, coupled with a hollow rod and having a lower traveling valve, wherein the said barrel is made stepped with the lower step of a greater diameter and the upper step of a lesser diameter, a through-hole is made in the plunger lateral wall above the lower traveling valve for the purpose of communication between the plunger cavity with a chamber formed during its downward motion in the barrel lower step, the barrel upper step is made with an inner diameter that is less than an inner diameter of a pipe string, a sub is made with an inner diameter that is less than an inner diameter of a pipe string, but that is not less than the inner diameter of the barrel upper step, the upper traveling valve is made as a bush arranged on a rod with the possibility of moving longitudinally upwards along it at an excess pressure in the above-plunger cavity of the barrel and moving downward in a liquid under its own weight, and is provided with a seat formed at the upper, internal end of the sub, a stop being arranged between the plunger and the upper traveling valve on a rod, which is made with the possibility of interacting with the upper traveling valve.

Also, the said objective is fulfilled, and the technical effect is achieved owing to the fact that a hollow rod above the upper traveling valve may be in communication with a pipe string.

BEST MODE FOR CARRYING OUT THE INVENTION

Figure 1:
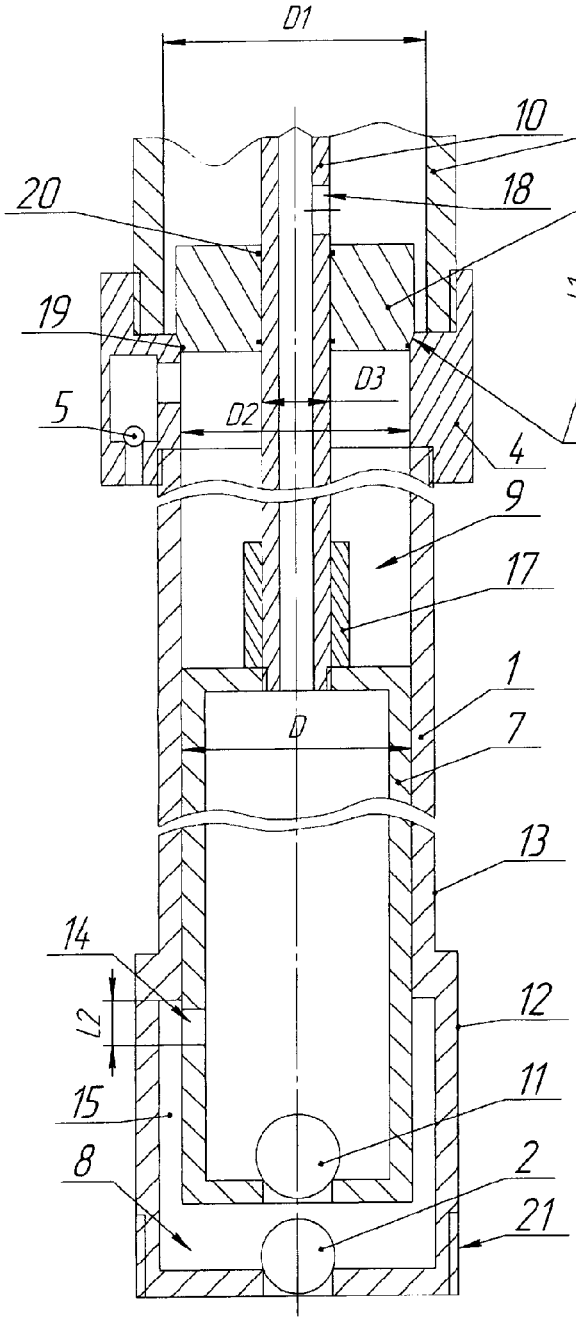
FIG. 1 shows a schematic view of the proposed pump.

The proposed double-action sucker-rod well pump comprises a barrel 1 (FIG. 1) having a lower standing valve 2 and connected to a pipe string 3 with the use of a sub 4 provided with an upper standing valve and an upper traveling valve 5, band a hollow plunger 7 arranged in the barrel 1 so as to form an under-plunger and an above-plunger cavities 8, 9, being able to move reciprocally, coupled to a hollow rod 10 and having a lower traveling valve 11. The barrel 1 is made stepped, with a lower step 12 of a greater diameter and an upper step 13 of a lesser diameter. A through hole 14 is made in the lateral wall of the plunger 7 above the lower traveling valve 11 for the purpose of communication between the cavity of the plunger 7with a chamber 15 formed when the plunger 7 moves downwards in the lower step 12 of the barrel 1. The upper step 13 of the barrel 1 is made with an inner diameter D that is less than an inner diameter D1 of the pipe string 3. The sub 4 is made with an inner diameter Douglas that is less than the inner diameter D1 of the pipe string 3, but that is not less than an inner diameter D of the upper step 13 of the barrel 1. The upper traveling valve 6 is made as a bush arranged on the rod 10 and being able to move longitudinally along it upwards at an excess pressure in the above-plunger cavity 9 of the barrel 1 and to move downwards in a liquid under its own weight, and is provided with a seat 16 formed on the upper inner end of the sub 4. A stop 17 is arranged on the rod 10 between the plunger 7 and the upper traveling valve 6, which stop is made with the possibility of interacting with the upper traveling valve 6. The hollow rod 10 above the upper traveling valve 6 may be in communication with the pipe string 3 via a hole 18.

The proposed pump can be operated as follows. The barrel 1 (FIG. 1) with the standing valves 2, 5 is lowered on the pipe string 3 connected to it via the sub 4 in a well. When an appropriate depth is reached, the barrel 1 with the pipe string 3 is filled with a well liquid through these valves 2, 5. Then, the plunger 7 with the traveling valves 6, 11 and the hollow rod 10 is lowered into the pipe string 3 on tension bars (not shown) until the plunger 7 enters the barrel 1. Owing to the fact that the inner diameter D of the upper step 13 of the barrel 1 is less than the inner diameter $D_1$ of the pipe string 3, and the inner diameter $D_2$ of the sub 4 is also less than the inner diameter $D_1$ of the pipe string 3, but is not less than the inner diameter D of the upper step 13 of the barrel 1, the plunger 1 may be lowered into a well on tension bars separately from the barrel 1. The upper traveling valve 6 is hermetically, owing to a seal 19, seated onto the seat 16, and its slipping connection with the rod 10 is sealed by seals 20. The plunger 7 is lowered firmly into the lower part of the barrel 1, which fact is fixed by a weight reduction on a wellhead weight indicator (not shown), thus enabling to correctly determine the mutual arrangement of the plunger 7 and the barrel 1. After this, the plunger 7 is raised into a required position relative to the barrel 1, and the tension bars are connected to a wellhead drive (not shown) having working stroke L (not shown). In order to start the pump, reciprocal motion is imparted to the tension bars and the plunger 7 by the wellhead drive via the rod. When the plunger 7 moves downwards relative to the barrel 1, the lower standing valve 2 is closed, and the lower traveling valve 11 is open, and a liquid from the under-plunger cavity 8 of the barrel 1 comes into the plunger 7 and, further, to the hollow rod 10. Simultaneously, a liquid from the well comes via the opened upper standing valve 5 into the above-plunger cavity 9 of the barrel 1, the upper traveling valve 6 being closed. When the plunger 7 moves relative to the barrel 1 upwards, the upper standing valve 5 is closed, and the upper traveling valve 6 is open, and a liquid from the above-plunger cavity 9 of the barrel 1 comes into the pipe string 3. Simultaneously, a liquid from the well comes into the under-plunger 8 of the barrel 1 through the open lower standing valve 2, and the lower traveling valve 11 is closed. After this, the cycles are repeated.

If a pump is intended for lifting a homogenous liquid (e.g., water, oil, watery oil or different formation products that allow mixing, etc.), then one-piece tension bars are used, and when the plunger 7 moves relative to the barrel 1 downwards, a liquid from the hollow rod 10 comes into the pipe string 3 through the hole 18 and, together with a liquid from the above-plunger 9 of the barrel 1, is lifted to the surface.

If a pump is intended for lifting liquids that are separated (e.g., into water and oil from a watered formation, or different formation products (not shown) that do not allow their mixing and are separated by a packer (not shown)) due to action of gravitational forces, then the hollow rod 10 without the hole 18 is used, and hollow tension bars are used. In this case the pump is arranged in a well so as the upper standing valve 5 is in communication with the well above the separation level (e.g., above a water-oil contact—WOC, or above a packer separating formations), and the lower standing valve 2—below the separation level. In order to ensure this arrangement of the pump, the barrel 1 may be provided, on its lower end, with an extension nipple or a shank with a packer (not shown) connected to the barrel 1 by, e.g., a thread 21 and communicating on its upper end with the lower standing valve 2, and on its lower end—with the well. When the pump is arranged in a well in such a way, a heavier liquid (e.g., water) or a lower formation product will be lifted to the surface via the hollow tension bars through the lower standing valve 2, the under-plunger cavity 8, the lower traveling valve 11, the plunger 7 and the hollow rod 10, and a lighter liquid (e.g., oil) or an upper formation product will be lifted to the surface via the pipe string 3 through the upper standing valve 5, the above-plunger cavity 9 and the upper traveling valve 6.

A maximum capacity $V_{1max}$ of the above-plunger cavity 9 of the barrel 1 for one working stroke of the plunger 7 (one cycle of reciprocal movement) is achieved, if the plunger 7 in the barrel 1 is set so that the stop 17 does not interact in the upper motion point (top dead point) with the valve 6 and does not forces it from the seat 16, and can be determined according to the formula:

$$V_{1max}=\pi(D^2-D_3^2)\cdot L/4, \quad [1]$$

where:

D is the inner diameter of the upper step 13 of the barrel 1, in meters;

$D_3$ is the outer diameter of the hollow rod 10, in meters;

L is length of the working stroke of the plunger 7 relative to the barrel 1, in meters.

Figure 2:
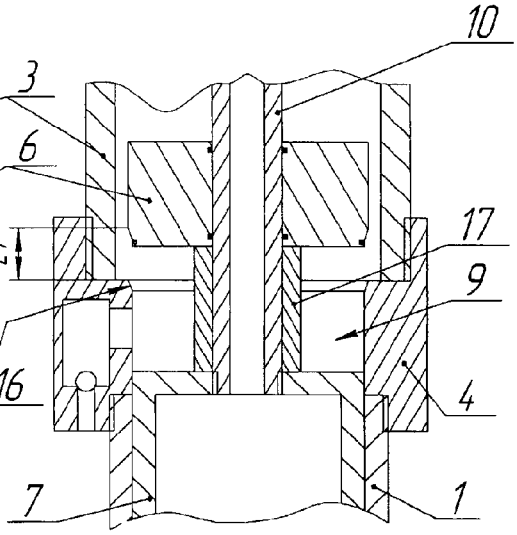
FIG. 2 shows the upper part of the proposed pump, when the plunger moves upward, and the stop interacts with the upper traveling valve.

The capacity $V_1$ of the above-plunger 9 of the barrel 1 for one working stroke of the plunger 7, provided that the plunger 7 in the barrel 1 is set so that the stop 17 interacts with the valve 6 in the upper dead point of its working stroke and forces it from the seat 16 by a length $L_1$ (FIG. 2), can be determined according to the formula:

$$V_1=\pi(D^2-D_3^2)\cdot(L-L_1)/4, \quad [2]$$

where:

D is inner diameter of the upper step 13 of the barrel 1, in meters;

$D_3$ is outer diameter of the hollow rod 10, in meters;

L is length of the working stroke of the plunger 7 relative to the barrel 1, in meters;

$L_1$ is length of the forced lift of the valve 6 off the seat 16 by the stop 17 when the plunger 7 is in the upper dead point of its working stroke, in meters.

That is to say, the capacity $V_1$ of the above-plunger cavity 9 of the barrel 1 is reduced with increasing length $L_1$ of forced lift of the valve 6 off the seat 16 by the stop 17, when the plunger 7 is in the upper dead point of its working stroke, due to the fact that, when the plunger 7 moves downwards by a length $L_1$, the above-plunger cavity 9 is in communication with the pipe string 3, and no underpressure is created therein before interaction between the valve 6 and the seat 16, which underpressure is required for pumping a well liquid into it through the upper standing valve 5 and, consequently, a less amount of a liquid will be pumped and come into the pipe string 3, when the plunger 7 moves upwards. Thus, by increasing or decreasing the length $L_1$, it becomes possible to reduce the capacity $V_1$ of the above-plunger 9 of the barrel 1 to zero (when $L=L_1$, provided the plunger 7 is within the limits of the barrel 1 in that time, pumping is carried out from the under-plunger cavity 8 when the above-plunger cavity 9 is removed from service) or increase it to full extent (when $L_1=0$—see Formula [1]) during a working stroke of the plunger 7.

A maximum capacity $V_{2max}$ of the under-plunger cavity 8 of the barrel 1 for one working stroke of the plunger 7 can be achieved, if the plunger 7 is arranged in the barrel 1 so as the hole 14 in the plunger 7 does not communicate in its lower stroke point (in lower dead point) with the chamber 15, and can be determined according to the formula:

$$V_{2max}=\pi\cdot D^2\cdot L/4, \quad [3]$$

where:

V is the inner diameter of the upper step 13 of the barrel 1, in meters;

L is a length of the working stroke of the plunger 7 relative to the barrel 1, in meters.

The capacity $V_2$ of the under-plunger cavity 8 of the barrel 1 for one working stroke of the plunger 7, if the plunger 7 in the barrel is set so as the hole 14 of the plunger 7 communicates in the lower stroke point (in lower dead point) with the chamber 15 and enters it by a length $L_2$ (FIG. 1), is determined according to the formula:

$$V_2=\pi\cdot D^2\cdot(L-L_2)/4 \quad [4]$$

where:

D is the inner diameter of the upper step 13 of the barrel 1, in meters;

L is a length of the working stroke of the plunger 7 relative to the barrel 1, in meters.

$L_2$ is a length by which the hole 14 of the plunger 7 enters the chamber 15 in the lower dead point, in meters.

That is to say, the capacity $V_2$ of the under-plunger cavity 8 of the barrel 1 is reduced with increasing the length $L_2$ by which the hole 14 of the plunger 7 enters into the chamber 15 in the lower dead point due to the fact that, when the plunger 7 moves upwards by the length L2, the under-plunger cavity 8 is in communication with the hollow rod 10 via the chamber 15, the hole 14 and the plunger 7, and, before the hole 14 exits the chamber 15, no underpressure is created that is necessary for pumping a well liquid through the lower standing valve 2, and, consequently, a less amount of a liquid will be pumped and come into the hollow rod 10 when the plunger 7 moves downwards. Thus, by increasing or reducing the length $L_2$ the capacity $V_2$ of the under-plunger cavity 8 of the barrel 1 can be, respectively, reduced to zero (when $L=L_1$, provided the plunger 7 is within the limits of the barrel 1 in that time, pumping is carried out from the under-plunger cavity 8 when the above-plunger cavity 9 is removed from service) or increase it to full extent (when $L_1=0$—see Formula [1]) during a working stroke of the plunger 7.

The basic unit for measuring a ratio between capacities of the above-plunger 9 and the under-plunger 8 of the barrel 1 is taken as a ratio of their maximum capacities, i.e., $V_{1max}$ and $V_{2max}$. Then, the following formula can be obtained from the formulae [1] and [3]:

$$K=V_{1max}/V_{2max}=1-(D_3/D)^2 \quad ,[5]$$

where:

K is a basic coefficient for ratios of capacities of cavities 9 and 8, that will be constant for each double-action pumps (usually, K=0.75-0.95);

D is the inner diameter of the upper step 13 of the barrel 1, in meters;

$D_3$ is the outer diameter of the hollow rod 10, in meters;

This basic coefficient relates to the pump operation when the stop 17 does not interacts with the valve 6 in the upper dead point, and the hole 14 of the plunger 7 is not in communication with the chamber 15 in the lower dead point.

In order to change a capacity ratio of the above-plunger cavity 9 and the under-plunger cavity 8 of the barrel 1, the wellhead drive is stopped, and the tension bars, as connected to it, are moved, respectively, upwards to a required amount for forced lifting of the valve 6 by the stop 17 by a length $L_1$ (FIG. 2) in the upper dead point or downwards so as the hole 14 of the plunger 7 may enter the chamber 15 (FIG. 1) by a length L2 in the lower dead point. Then the drive is operated once again.

When the tension bars move upwards, a capacity ratio of the above-plunger cavity 9 and the under-plunger cavity 8 of the barrel 1, taking forced lift of the valve 6 by the stop 17 and the formulae [2] and [3] into account, takes the following form:

$$K_1=V_1/V_{2max}=K\cdot(1-L_1/L), \quad [6]$$

where:

K is a basic coefficient of capacity ratios of the cavities 9 and 8, which will be constant for each of double-action pumps (usually K=0.75-0.95);

L is a length of the working stroke of the plunger 7 relative to the barrel 1, in meters.

$L_2$ is a length of forced lift of the valve 6 off the seat 16 by the stop 17 when the plunger 7 is in the upper dead point of its working stroke, in meters.

When the tension bars move downwards, the capacity ratio K2 of the above-plunger cavity 9 and the under-plunger cavity 8 of the barrel 1, taking entering of the hole 14 of the plunger 7 into the chamber 15 and the formulae [1] and [4] into account, takes the following form:

$$K_2=V_{1max}/V_2=K/(1-L_2/L), \quad [7]$$

where:

K is a basic coefficient of capacity ratios of the cavities 9 and 8, which will be constant for each of double-action pumps (usually K=0.75-0.95);

L is a length of the working stroke of the plunger 7 relative to the barrel 1, in meters;

$L_2$ is a length by which the hole 14 of the plunger 7 enters the chamber 15 in the lower dead point, in meters.

If a pump is operated with forced lift of the valve 6 off the seat 16 by the stop 17 by a length $L_1$ (FIG. 2) in the upper dead point and with entering of the hole 14 of the plunger 7 into the chamber 15 (FIG. 1) by a length $L_2$ in the lower dead point, then the capacity ratio $K_3$ of the above-plunger cavity 9 and the under-plunger cavity 8 of the barrel 1, taking the formulae [2] and [4] into account, takes the following form:

$$K_3=V_1/V_2=K\cdot(1-L_1/L)/(1-L_2/L), \quad [8]$$

where:

K is a basic coefficient of capacity ratios of the cavities 9 and 8, which will be constant for each of double-action pumps (usually K=0.75-0.95);

L is a length of the working stroke of the plunger 7 relative to the barrel 1, in meters;

$L_1$ is a length of forced lift of the valve 6 off the seat 16 by the stop 17 when the plunger 7 is in the upper dead point of its working stroke, in meters.

$L_2$ is a length by which the hole 14 of the plunger 7 enters the chamber 15 in the lower dead point, in meters.

When adjusting from the well head and from corresponding calculations, an increase in $L_2$ or $L_1$ during a downward (by lifting) or upward (by lowering) movement of the tension bars with the hollow rod 10 and the plunger 7 relative to the connection with the wellhead drive by a calculated length $\Delta L$ results in a corresponding decrease in $L_1$ or $L_2$ by this calculated length $\Delta L$.

An adjustment of capacity ratios of the cavities 9 and 8 is carried out proceeding from the formulae [5]-[8].

Ratios of $K_1$, $K_2$ or $K_3$ values for percentage of capacities of the cavities 9 and 8 are shown in the Table.

TABLE

| $K_1$, $K_2$ or $K_3$ | Capacity of the above-plunger cavity 9, % | Capacity of the under-plunger cavity 8, % |
|---|---|---|
| 0 | 0 | 100 |
| 0.1 | 9.09 | 90.91 |
| 0.2 | 16.67 | 84.43 |
| 0.3 | 23.08 | 76.02 |
| 0.4 | 28.57 | 71.43 |
| 0.5 | 33.33 | 66.67 |
| 0.6 | 37.5 | 62.5 |
| 0.7 | 41.18 | 58.82 |
| 0.8 | 44.44 | 55.56 |
| 0.9 | 47.37 | 52.63 |
| 1 | 50 | 50 |
| 1.1 | 52.38 | 47.62 |
| 1.2 | 54.54 | 45.46 |
| 1.3 | 56.52 | 43.48 |
| 1.4 | 58.33 | 41.67 |
| 1.5 | 60 | 40 |
| 1.6 | 61.54 | 38.46 |
| 1.7 | 62.96 | 37.04 |
| 1.8 | 64.29 | 35.71 |
| 1.9 | 65.52 | 34.48 |
| 2.0 | 66.67 | 33.33 |
| 2.5 | 71.43 | 28.57 |
| 3 | 75 | 25 |
| 3.5 | 77.78 | 22.22 |
| 4 | 80 | 20 |
| 5 | 83.33 | 16.67 |
| 6 | 85.71 | 14.29 |
| 7 | 87.5 | 12.5 |
| 8 | 88.89 | 11.11 |
| ∞ | 100 | 0 |

A capacity value for the cavities 9 and 8 shows in which proportion a pump obtains a product through the upper standing valve 5 and the lower standing valve 2, respectively.

By using data from the Table, one may determine values for the lengths $L_2$ (according to the formulae [5] and [6]), $L_1$ (according to the formulae [5] and [7]) or $L_2$ and $L_1$ (according to the formulae [5] and [8]). If calculated values of $L_2$, $L_1$ or $L_2$ and $L_1$ differ from values of a pump in operation, then a maximum approach to a required capacity ratio of the cavities 8 and 9 may be obtained by moving the tension cars upwards or downwards relative to the connection with a wellhead drive by a calculated length $\Delta L$. Thus, relation of products extracted through the upper standing valve 5 and the lower standing valve 2 may be regulated without lifting the pump to the surface, which is important for extracting a liquid that is separated (e.g., into oil and water) or when extracting products from different formations with one double-action pump.

Owing to making the upper traveling valve 6 as a bush arranged on the rod 10 with the possibility of moving longitudinally along it, it becomes possible to raise its flow rate for the given barrel 1, and, thereby, reduce hydraulic resistance of a liquid flowing through it (especially for viscous liquids, such as oil, pitch mineral, etc.), which does not allow accumulation of a gas exiting the liquid and increases the pump efficiency.

INDUSTRIAL APPLICABILITY

The proposed pump is simple and reliable in operation, has high efficiency due to decreased hydraulic resistance of the upper traveling valve and has expanded process capabilities due to the possibility of lifting a liquid from the above-plunger cavity and the under-plunger cavity of the barrel as well as adjusting the pump capacity by adjusting a ratio of its above-plunger cavity and the under-plunger cavity during a downward or upward movement. The invention may be used in the oil producing industry.

What is claimed is:

1. A double-action sucker-rod well pump comprising:

a barrel, having a lower standing valve and connected to a pipe string with the use of a sub provided with an upper standing valve and an upper traveling valve, and a hollow plunger arranged in the barrel so as to form an under-plunger and an above-plunger cavities with the possibility of moving reciprocally, coupled with a hollow rod and having a lower traveling valve, characterized in that the barrel is made stepped with the lower step of a greater diameter and the upper step of a smaller diameter, the lateral wall of the plunger is provided with a through-hole above the lower traveling valve that is intended for communication between the plunger cavity with a chamber forming when the plunger moves downwards in the lower step of the barrel, the upper step of the barrel is made with an inner diameter that is less than the inner diameter of a pipe string, a sub is made with an inner diameter that is less than the inner diameter of a pipe string, but that is not less than the inner diameter of the upper step of the barrel, the upper traveling valve is made as a bush arranged on a rod with the possibility of moving along it longitudinally at an overpressure in the above-plunger cavity of the barrel and moving downwards in a liquid under its own weight, and is provided with a seat formed at the inner upper end of the sub, a stop being arranged on the rod between the plunger and the upper traveling valve and being made with the possibility of interacting with the upper traveling valve.

2. The pump of claim 1, wherein the hollow rod above the upper traveling valve is in communication with a pipe string.

* * * * *